US010417881B2

(12) United States Patent
Byrne et al.

(10) Patent No.: US 10,417,881 B2
(45) Date of Patent: Sep. 17, 2019

(54) WIRELESS STATUS INDICATOR LIGHT

(71) Applicants: Norman R. Byrne, Ada, MI (US); Nickolas J. Morrow, Ada, MI (US)

(72) Inventors: Norman R. Byrne, Ada, MI (US); Nickolas J. Morrow, Ada, MI (US)

( * ) Notice: Subject to any disclaimer, the term of this patent is extended or adjusted under 35 U.S.C. 154(b) by 0 days.

(21) Appl. No.: 15/499,331

(22) Filed: Apr. 27, 2017

(65) Prior Publication Data

US 2017/0316659 A1 Nov. 2, 2017

Related U.S. Application Data

(60) Provisional application No. 62/330,386, filed on May 2, 2016, provisional application No. 62/342,385, filed on May 27, 2016.

(51) Int. Cl.
*G08B 7/06* (2006.01)

(52) U.S. Cl.
CPC ..... *G08B 7/06* (2013.01)

(58) Field of Classification Search
None
See application file for complete search history.

(56) References Cited

U.S. PATENT DOCUMENTS 5,428,663 A * 6/1995 Grimes ..... H04M 3/42229 340/7.1
5,752,191 A * 5/1998 Fuller ..... H04M 1/006 455/445
5,848,362 A * 12/1998 Yamashita ..... H04M 19/04 455/567
6,018,665 A * 1/2000 Chavez, Jr. ..... H04M 1/725 455/462
6,125,285 A * 9/2000 Chavez, Jr. ..... H04M 1/725 455/418
6,147,608 A * 11/2000 Thacker ..... G08B 5/00 340/330
6,181,237 B1 * 1/2001 Gehlot ..... H04B 3/23 340/407.1
6,249,222 B1 * 6/2001 Gehlot ..... G08B 1/08 340/12.54
6,344,795 B1 * 2/2002 Gehlot ..... G08B 1/08 340/4.1
6,445,087 B1 * 9/2002 Wang ..... H01R 25/003 307/139
6,607,484 B2 * 8/2003 Suzuki ..... A61B 5/0002 128/903

(Continued)

OTHER PUBLICATIONS

Embrava Blynclight User Guide, Copyright 2014.

*Primary Examiner* — Curtis J King
(74) *Attorney, Agent, or Firm* — Gardner, Linn, Burkhart & Ondersma LLP

(57) ABSTRACT

A visual indicator system including a communications module, a processor, and a visual indicator. The communications module is able to wirelessly receive a condition report from a wirelessly connected device. The processor is able to select a status in response to the condition report received by the communications module. The visual indicator is able to visually indicate a status based upon a selected visual configuration of the visual indicator. The processor is also able to select a particular configuration for the visual indicator based upon the selected status.

20 Claims, 5 Drawing Sheets

(56) References Cited

U.S. PATENT DOCUMENTS 6,788,953 B1 * 9/2004 Cheah ..... H04W 88/02 379/158
7,016,707 B2 * 3/2006 Fujisawa ..... H04M 1/6505 340/573.1
7,239,892 B2 * 7/2007 Martin ..... H04B 3/54 455/557
7,474,889 B2 * 1/2009 Bhakta ..... H04W 88/02 455/412.1
7,663,866 B2 * 2/2010 Lee ..... H01R 13/652 307/117
7,945,292 B2 * 5/2011 Sweeney ..... H04B 1/385 455/41.2
8,165,640 B2 * 4/2012 Mullen ..... H04M 1/72527 455/412.2
8,482,252 B2 7/2013 Byrne
8,558,665 B2 * 10/2013 Um ..... H04N 7/141 340/5.74
8,601,529 B1 * 12/2013 Barzegar ..... H04L 12/12 725/150
8,923,804 B1 * 12/2014 Aldridge, II ..... H04W 4/008 455/404.2
9,300,347 B1 * 3/2016 Coverstone ..... H04B 1/3888
9,335,357 B2 * 5/2016 Washiro ..... H04B 3/546
9,402,326 B2 * 7/2016 Hedstrom ..... H05K 7/005
9,537,534 B2 * 1/2017 Tsai ..... H04B 3/542
9,685,052 B2 * 6/2017 Kashar ..... G04G 21/04
2002/0135807 A1 * 9/2002 Idehara ..... H04N 1/00127 358/1.15
2002/0186122 A1 * 12/2002 Gehlot ..... H04M 1/72527 340/7.58
2003/0041101 A1 * 2/2003 Hansche ..... H04L 29/06 709/203
2003/0164787 A1 * 9/2003 Dresti ..... G08C 17/00 341/176
2004/0222879 A1 * 11/2004 Sawyer ..... G08B 6/00 340/407.1
2005/0240346 A1 * 10/2005 Lin ..... G01S 5/0009 701/469
2005/0272408 A1 * 12/2005 Wilkes-Gibbs ... H04M 1/72572 455/412.2
2005/0280550 A1 * 12/2005 Kurian ..... G09F 9/33 340/815.45
2006/0240817 A1 * 10/2006 Akiyama ..... H04W 88/04 455/426.2
2006/0255963 A1 * 11/2006 Thompson ..... G08C 17/02 340/12.23
2007/0049197 A1 * 3/2007 Klein ..... H04M 1/6091 455/41.2
2007/0206629 A1 * 9/2007 Choi ..... H04L 12/66 370/463
2008/0094210 A1 * 4/2008 Paradiso ..... H04L 12/2827 340/540
2008/0293453 A1 * 11/2008 Atlas ..... G08B 6/00 455/567
2009/0072955 A1 * 3/2009 Cary ..... G08B 6/00 340/407.1
2009/0088207 A1 * 4/2009 Sweeney ..... H04M 19/04 455/557
2009/0097363 A1 * 4/2009 Nyberg ..... G04G 9/0064 368/251
2009/0215501 A1 * 8/2009 Kim ..... H04M 19/04 455/567
2010/0022220 A1 * 1/2010 Gupta ..... H04W 4/12 455/412.2
2010/0022230 A1 * 1/2010 Shim ..... H04M 1/72505 455/417
2010/0255779 A1 * 10/2010 Lee ..... H01R 13/665 455/41.2
2010/0284526 A1 * 11/2010 Dempsey ..... H04M 11/007 379/102.07
2011/0072083 A1 * 3/2011 Suetsugu ..... G06F 13/385 709/203
2011/0084651 A1 * 4/2011 Caskey ..... H01R 25/006 320/107
2011/0254684 A1 * 10/2011 Antoci ..... H04M 1/7253 340/539.13
2012/0060044 A1 * 3/2012 Jonsson ..... G01D 4/002 713/340
2012/0108215 A1 * 5/2012 Kameli ..... H04M 1/0256 455/412.2
2012/0127637 A1 5/2012 Byrne et al.
2012/0238330 A1 * 9/2012 Wu ..... H04M 1/7253 455/569.1
2012/0329447 A1 * 12/2012 Gilbert ..... H04M 1/72566 455/420
2013/0176738 A1 * 7/2013 Tinaphong ..... F21V 33/00 362/253
2013/0207778 A1 * 8/2013 Neafsey ..... H04M 1/7253 340/5.61
2013/0214998 A1 * 8/2013 Andes ..... G02B 27/017 345/8
2013/0231161 A1 * 9/2013 Hsu ..... G09G 3/3648 455/566
2014/0002261 A1 * 1/2014 Ashbrook ..... G08B 6/00 340/539.11
2014/0053185 A1 * 2/2014 Bleacher ..... H04N 21/41422 725/26
2014/0188485 A1 * 7/2014 Kim ..... G10L 21/00 704/275
2014/0265577 A1 * 9/2014 Beckman ..... H02J 3/14 307/39
2014/0359712 A1 * 12/2014 Takayama ..... H04L 63/107 726/4
2015/0061842 A1 * 3/2015 Yoon ..... G04G 21/04 340/12.5
2015/0067803 A1 * 3/2015 Alduaiji ..... G06F 21/31 726/7
2015/0145656 A1 * 5/2015 Levesque ..... G06F 1/163 340/407.1
2015/0332580 A1 * 11/2015 Bokhary ..... G08B 25/016 340/539.13
2015/0379842 A1 * 12/2015 Di Censo ..... G08B 13/2491 340/565
2016/0112988 A1 * 4/2016 Lee ..... H04W 4/008 455/458
2016/0174347 A1 * 6/2016 Parello ..... H05B 33/0845 315/294
2016/0190748 A1 * 6/2016 Emby ..... H01R 13/6691 340/654
2016/0216943 A1 * 7/2016 Welti ..... G06F 1/163
2016/0238263 A1 * 8/2016 Meissner ..... F24F 13/24
2016/0300403 A1 * 10/2016 Harter ..... G07C 5/008
2016/0300404 A1 * 10/2016 Harter ..... G07C 5/008
2016/0300407 A1 * 10/2016 Harter ..... G07C 5/085
2016/0309307 A1 * 10/2016 Agarwal ..... H04W 4/12
2016/0316544 A1 * 10/2016 Rice ..... H05B 37/029
2017/0038739 A1 * 2/2017 Nakamura ..... G04R 20/26
2017/0181255 A1 * 6/2017 Jeremy ..... H05B 37/0272
2017/0251356 A1 * 8/2017 Andrade ..... H04W 8/08
2018/0069815 A1 * 3/2018 Fontana ..... H04L 51/04
2018/0177325 A1 * 6/2018 Lyons ..... A47J 31/005

* cited by examiner

WIRELESS STATUS INDICATOR LIGHT

CROSS REFERENCE TO RELATED APPLICATIONS

The present application claims the filing benefits of U.S. provisional applications, Ser. No. 62/342,385, filed May 27, 2016, and Ser. No. 62/330,386, filed May 2, 2016, which are both hereby incorporated by reference herein in their entireties.

FIELD OF THE INVENTION

The present invention is directed to status indicators, such as for providing visual and/or aural signals indicative of phone usage or a person's general availability.

BACKGROUND OF THE INVENTION

Indicator lights have been interfaced with telephone systems and are used to provide a visual notification related to an individual telephone device of that telephone system. For example, a particular visual notification device paired with a particular telephone device on a telephone system may be used to provide visual notification to others that a user of the telephone device may be currently on a phone call, may be busy with a project and wishes to not be disturbed, or may wish to indicate that they are available. The telephone systems may include both hardware-based infrastructure and/or cloud-based infrastructure.

SUMMARY OF THE INVENTION

The present invention provides wireless connectivity between one or more of a portable computing device, a cellphone, smart phone, laptop, and any other computing device, and a status indicator system. Such wireless connectivity to a particular visual indicator allows for a connected portable device, laptop, or desktop computer to be used to provide clear indication of a user's status, to others, via the connected visual indicator system, and may further be used to provide the user with information regarding incoming calls or messages, active call status, and the like.

In one form of the present invention, a visual indicator system includes a visual indicator capable of visual indicating one or more status based upon a selected color displayed by the visual indicator, and a processor configured to select a status in response to receiving a condition report from a wirelessly connected device. The processor is further configured to indicate the selected status via the visual indicator. The processor commands the visual indicator to display at least one of a particular color, light intensity, and flashing cycle rate, based upon the selected status.

According to an aspect of the present invention, the visual indicator system includes a light fixture that outputs light in one of a plurality of colors. For example, the light fixture may output green, red, purple, and yellow colored lights. The light fixture may also output a varying light intensity, and a flashing light with a varying cycle rate.

According to another aspect of the present invention, the visual indicator system includes an auditory indicator that is able to output an audible signal to indicate when a call, text message, email, or voice mail has been received. Similar to the light fixture, the auditory indicator may also output a variety of audio tones and/or tunes. The auditory indicator may also output the audible signal with a varying volume level.

According to another aspect of the present invention, the visual indicator system may also define a status as one of busy, available, and away. The busy status may refer to an "on a call" condition, or a "do not disturb" condition.

According to another aspect of the present invention, the visual indicator system may also define a condition as one of "on a call," "text message received," "email message received," "voicemail received," "call received," "user busy," "do not disturb," and "user away."

According to another aspect of the present invention, the visual indicator system may also include a communications module that receives the condition report from the connected device. The communications module may include a wireless receiver. The wireless receiver may be one of a Bluetooth receiver, a near field communication (NFC) receiver, and a Wi-Fi receiver.

According to another aspect of the present invention, the visual indicator system may include a device that is one of a portable computing device, a computer, and a cellphone.

According to yet another aspect of the present invention, a method for indicating a status includes receiving condition reports, selecting a particular status, and indicating the selected status. The condition reports may be received from a connected device. The particular status may be selected in response to the condition report that was received. The selected status may be indicated via a visual indicator by commanding the visual indicator to go to a particular configuration based upon the selected status. The device is connected to the visual indicator via a wireless connection. The configuration indicates at least one of a particular light color, light intensity, and light flashing cycle rate.

These and other objects, advantages, purposes and features of this invention will become apparent upon review of the following specification in conjunction with the drawings.

DESCRIPTION OF THE PREFERRED EMBODIMENTS

Figure 1:
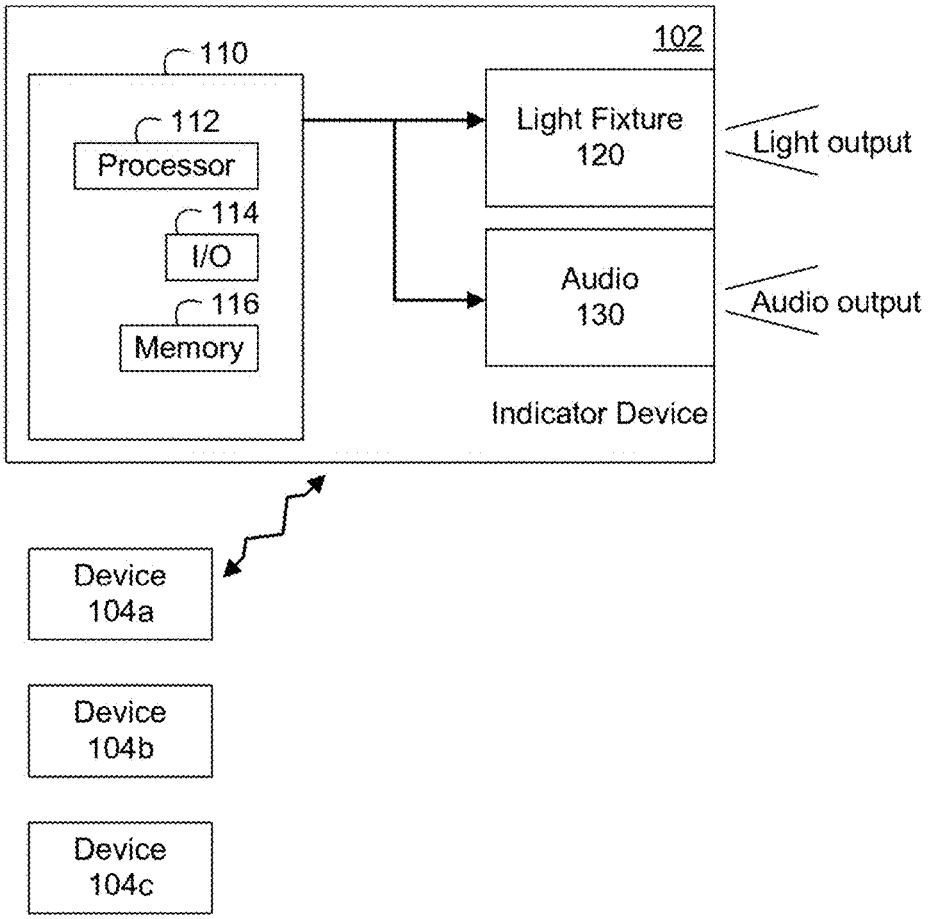
FIG. 1 is a block diagram illustrating an exemplary visual indicator system interfacing wirelessly with an exemplary device in accordance with an embodiment of the present invention.

Referring now to the drawings and the illustrative embodiments depicted therein, a visual indicator system is configured to provide visual indications of a user's status by wirelessly interfacing with a portable computing device associated with the user. As discussed herein, the visual indicator system provides wireless connectivity between a portable computing device, cell phone, laptop, or other computing device, and a status indicator system. Such wireless connectivity to a particular visual indicator allows for a wirelessly connected or paired device to be used to provide a signal indicative of the user's status to the visual indicator for display by the visual indicator, when the user's device enters the wireless range of the status indicator system. For example, when a connected device is being used on a call, the active call status may be indicated by the visual indicator. Similarly, the visual indicator may be used to indicate when an incoming call, voicemail, or text message has been received by the connected device. Such visual status cues may be used to notify the user of an incoming call, text message, or voice mail, as well as to provide notice to others when the user is busy, e.g., on a call, or does not wish to be disturbed.

As illustrated in FIG. 1, a visual indicator system 100 comprises a visual indicator 102 that wirelessly connects to a user's device 104 when the user's device 104 has been placed within wireless range of the visual indicator 102. When a user brings a particular device, for example a device 104*a*, into wireless range of the visual indicator 102, a wireless connection will be established with the visual indicator 102 via a wireless receiver of the visual indicator 102. In FIG. 1, the wireless receiver is indicated as an Input/Output (I/O) device 114. In one embodiment, the I/O device 114 is a Bluetooth wireless receiver. In another embodiment, the I/O device 114 is a Wi-Fi wireless receiver. In yet another embodiment, the I/O device 114 may be a near field communication (NFC) receiver or other similar wireless receiver.

A condition report may be transmitted from the device 104*a* to a control module 110 of the visual indicator 102 via a wireless communications link established between the device 104*a* and the visual indicator 102. Exemplary conditions may include:

1. Instant or text message received by the linked device.
2. Incoming phone call on the linked device.
3. When the linked device is on a call or similar action, e.g., video call.
4. When a user of the linked device wishes to indicate that they are "available," that is, not on a call or similar activity.
5. When a user of the linked device wishes to indicate that they are "busy," that is, on a call or similar activity.
6. When the user of the linked device wishes to indicate that they do not want to be disturbed.

Optionally, the available conditions include conditions that are selected based upon the device's current state. For example, when a device 104 is receiving a call, voicemail, or text message, or the user is already on a call with the device 104, the condition report may indicate such. Additionally, the condition report from the device 104 may be user selectable. For example, if the user wishes to indicate they are "busy," whether they are on a call or not, or that they do not want to be disturbed, the user may manually select such conditions.

Based upon the received condition report from the connected device 104, a processor 112 of the control module 110 will select a status to be indicated by the visual indicator 102. As illustrated in FIG. 1, the status selected by the processor 112 may be used to configure a command to be received by either one or both of a light fixture 120 and an audio device 130. Such a command may be used to cause the light fixture 120 to flash a particular color when an incoming call or text message has been received. Similarly, the light fixture 120 may glow a particular color based upon the selected status. For example, a green light may be used to indicate that the user is available to receive a call or is available for other activities. Similarly, a red or purple light may be used to indicate that the user is busy, e.g., on a call, or does not want to be disturbed, respectively. Lastly, a yellow light may be used when the user wishes to step away from the linked device 104*a*. When the user steps away from the visual indicator 102, and takes the linked device 104*a* with them, once the linked device 104*a* moves beyond the wireless range of the connection, the link will be broken and the visual indicator 102 will be returned to a ready state. Such a ready state may be indicated with a light-off configuration. The light fixture 120 may change color, light brightness or a flashing cycle rate depending on the selected status. For example, based upon the selected status, the processor 112 commands the light fixture 120 to display at least one of a particular light color, variable light intensity, and variable flashing cycle rate. Optionally, processor 112 and light fixture 120 may be configured to provide a visual indication of two or more statuses at a selected priority level, such as by primarily displaying a red light to indicate that the user is on an active call, and by briefly displaying purple light to indicate that the user does not wish to be disturbed even after the active call is complete. It is further envisioned that multiple colors or flashing patterns could be displayed at once, to provide more than one visual status indication at one time.

As also illustrated in FIG. 1, an audio device 130 may also receive the command and consequently output an audio signal indicative of the selected status. For example, a particular audio signal may be output via a speaker of the audio device 130 when a call or message is received. Similar to the light fixture 120, the audio device 130 may output a variety of audio tones and/or tunes. The audio device 130 may also output the audible signal with a variable volume level. In one embodiment, the audio output may be used to indicate to the user when incoming calls or messages have been received by the device 104, when the user is away from the linked device 104 but within audio range of the linked device 104.

As illustrated in FIG. 1, when a second user with a device 104*b* enters the wireless range of the visual indicator 102—when the visual indicator 102 is in a ready state and able to wirelessly connect—the device 104*b* will connect with the visual indicator 102 as discussed above. Once connected, the second user's status may be indicated with the visual indicator as discussed above. For example, when the visual indicator 102 has connected to a device 104*a* of a first user, a second user with a connectable device 104*b* will not be connected with the visual indicator 102 until the first user's device 104*a* is no longer connected to the visual indicator 102.

Figure 2:
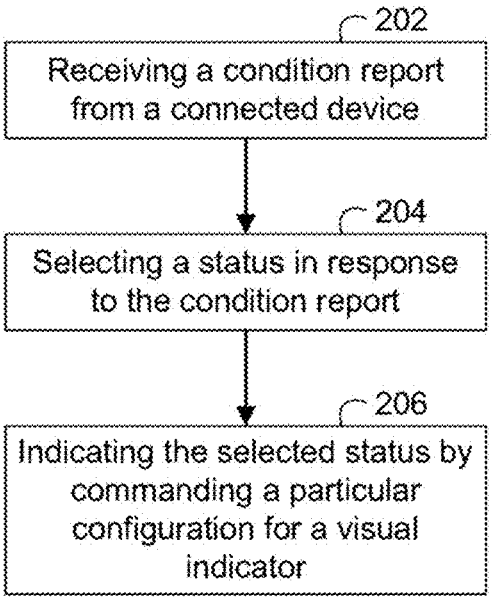
FIG. 2 is a flow diagram of the steps to a computer-implemented method for indicating a status with a visual indicator system in accordance with an embodiment of the present invention.

FIG. 2 illustrates an exemplary flow diagram of a computer implemented method for indicating a user's status via a wireless connection between a connected device 104 and a visual indicator 102. In step 202 of FIG. 2, a condition report is received from the connected device 104. As discussed above, the connected device 104 is wirelessly connected to the visual indicator 102 via a Bluetooth, NFC, or Wi-Fi connection. In step 204 of FIG. 2, a status is selected in response to the received condition report. As discussed herein, a particular status or alert may be selected based upon the received condition report which may indicate a current condition, e.g., incoming call or message, on a call, user indicates they are busy, available, or not to be disturbed. Lastly, in step 206 of FIG. 2, the selected status is indicated via a visual indicator by commanding the visual indicator's light fixture 120 to go to a particular configuration based upon the selected status. For example, a particular configuration may include a particular light color to display, a particular variable light brightness, or variable flashing light cycle rate. Additionally, as also discussed herein, in addition, the command may be used to cause an audio device 130 to output a particular audio signal.

Figure 3:
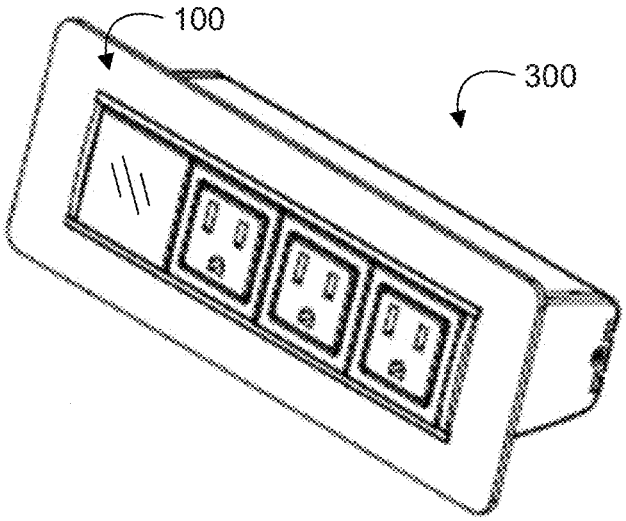
FIGS. 3-5 are exemplary perspective views of a variety of power and data housing units configured for receiving a visual indicator system in accordance with an embodiment of the present invention.
Figure 4:
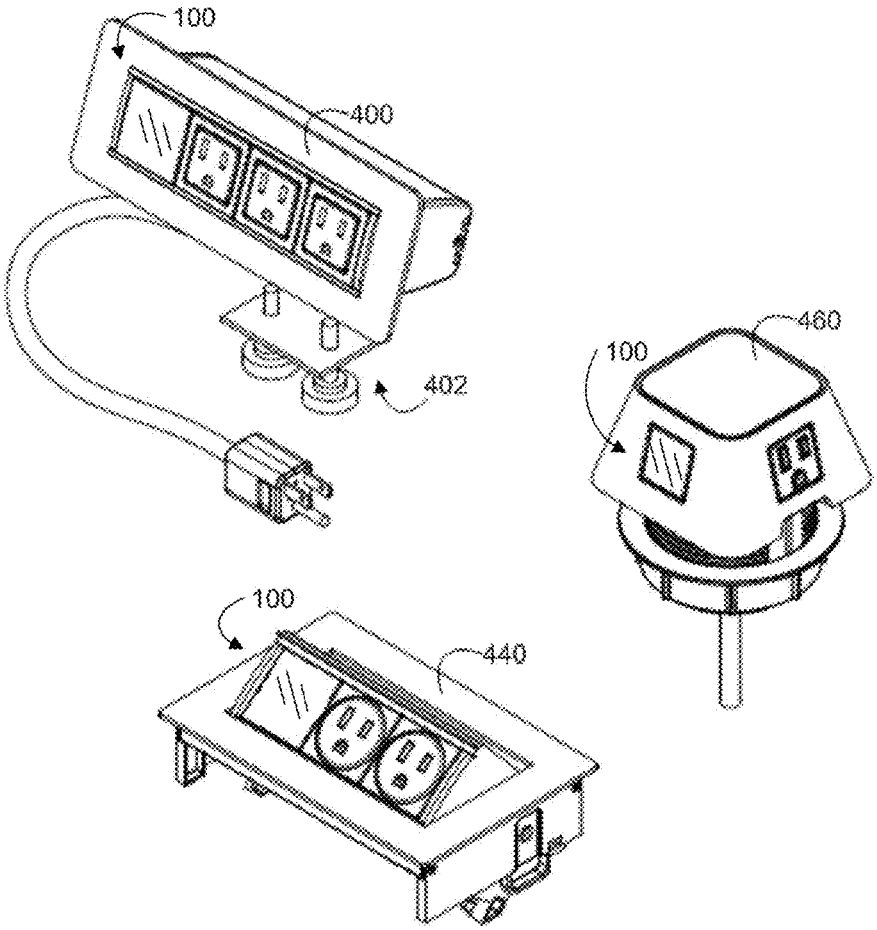
Figure 5:
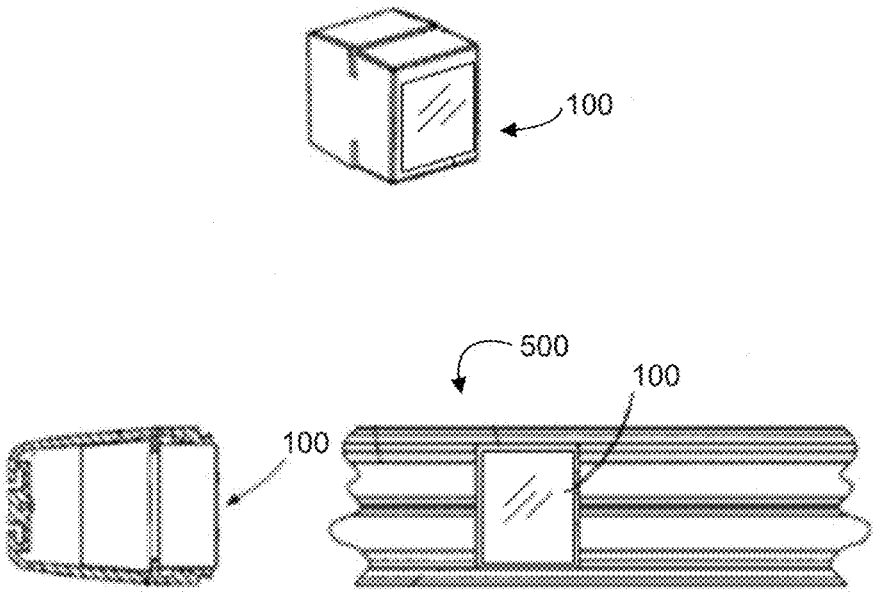

As illustrated in FIGS. 3-5 the visual indicator system 100 may be implemented in any of the following exemplary configurations. FIG. 3 illustrates that a visual indicator system 100 may be implemented as an electrical device assembly inserted into a power and data housing 300. Such a power and data housing 300 is discussed in detail in commonly owned U.S. Pat. No. 8,480,429 issued to Norman R. Byrne, entitled "Power Data Housing," the disclosure of which is hereby incorporated herein by reference. Additional embodiments for an exemplary power and data housing are disclosed and discussed in detail in commonly owned U.S. Pat. No. 9,312,673 issued to Norman R. Byrne, entitled "Low Voltage Power Receptacle," the disclosure of which is hereby incorporated herein by reference. Further embodiments and additional details may be found in commonly assigned U.S. patent application Publication No. 2012/0127637, issued to Norman R. Byrne et al., entitled "Receptacle Timer," the disclosure of which is hereby incorporated herein by reference. It will be appreciated that exemplary visual indicator system embodiments may be configured for and inserted into other housing embodiments. Such additional mounting embodiments are discussed in detail in the following commonly owned patents: U.S. Pat. No. 8,444,432, issued to Norman R. Byrne, entitled "Power and Data Adapter Assembly," U.S. Pat. No. 8,721,124, issued to Norman R. Byrne, entitled "Retractable Light Assembly," U.S. Pat. No. 8,736,106, issued to Norman R. Byrne, entitled "International Outlet System," and U.S. Pat. No. 9,220,342, issued to Norman R. Byrne, entitled "Table Coupling System With Power And Data." Additional mounting embodiments as also discussed in detail in commonly owned U.S. patent application Ser. No. 15/062,944, by Norman R. Byrne, entitled "Portable Electrical Power Unit," Which corresponds to U.S. patent application Publication No. 2016/0268825.

As illustrated in FIG. 4, and discussed in U.S. Pat. No. 9,312,673, a visual indicator system 100 may be implemented as an electrical device assembly inserted into a variety of configurations. For example, a visual indicator system 100 may be configured for and inserted into power and data housing unit 400 that has been configured with an edge clamp 402 for attaching to the edge of a table or desk surface. A visual indicator system 100 may be configured for and inserted into a power and data housing unit 440 that is configured to be inserted into a horizontal tabletop surface. Lastly, a visual indicator system 100 may be configured for and inserted into a power and data housing unit 460 that is configured as a monument or monument-grommet mount for mounting in a horizontal surface of a work surface and/or tabletop.

As illustrated in FIG. 5, an exemplary power and data housing unit 500 may be configured to receive an electrical device assembly, which may include an exemplary visual indicator system 100. FIG. 5 illustrates the use of the power and data housing unit 500 and a channel with a visual indicator system 100. For purposes of releasably securing the electrical device assembly within a channel of the power and data housing unit 500, the visual indicator system 100 may include additional appropriate components to be received within and captured by upper and lower channels, such that the visual indicator system 100 is slidably inserted into the channel. The above power and data housing unit 500 and channel are discussed in detail in the above-referenced U.S. Pat. No. 8,480,429.

Thus, the visual indicator system provides users and others with a quick visual indication of a given user's status or availability based on signals that are wirelessly received from a portable electronic device, such as a mobile phone or tablet computer, that is associated with that user. A communications module may be located at a work area that is designated for the user, for at least a limited period of time, and is able to wirelessly receive a condition report from a wirelessly connected device associated with that user. A processor selects a status in response to the condition report received by the communications module. The visual indicator provides a status indication, such as "busy," "available," and "on an active call," based upon a selected visual configuration of the visual indicator.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A visual indicator system comprising:

a communications module configured to wirelessly receive a condition report from a wirelessly connected device associated with an individual user, wherein the condition report corresponds directly to a current condition of the individual user;

a processor configured to select a status in response to the condition report received by the communications module, wherein the selected status is indicative of a current, ongoing activity of the individual user, as defined by the condition report; and a visual indicator configured to visually indicate to other users a selected status of the individual user based upon a visual configuration for the visual indicator;

wherein the processor is further configured to select a particular configuration for the visual indicator based upon the selected status; and wherein the visual indicator system is retained and supported in a power and data housing assembly comprising a voltage outlet and a data port, wherein the voltage outlet comprises at least one of a line voltage AC outlet and a low voltage DC outlet.

2. The visual indicator system of claim 1, wherein the visual indicator comprises a light fixture configured to generate an output light in one of a plurality of colors, wherein an intensity of the output light is variable, and wherein the output light comprises a variable flashing cycle rate.

3. The visual indicator system of claim 1 further comprising an auditory indicator configured to output an audio output signal.

4. The visual indicator system of claim 3, wherein the auditory indicator works in parallel with the visual indicator.

5. The visual indicator system of claim 1, wherein the selected status is indicative of one of: "busy," "available," and "away".

6. The visual indicator system of claim 1, wherein the condition report is indicative of one of: "on a call," "text message received," "voicemail received," "email message received," "call received," "user busy," and "user away".

7. The visual indicator system of claim 1, wherein the communications module comprises a wireless receiver.

8. The visual indicator system of claim 7, wherein the wireless receiver is one of a Bluetooth receiver, a near field communication (NFC) receiver, and a Wi-Fi receiver.

9. The visual indicator system of claim 1, wherein the wirelessly connected device comprises one of a portable computing device, a computer, and a cellphone.

10. A method for indicating a status, the method comprising:

wirelessly receiving, with a visual indicator system retained in a power and data housing assembly, a condition report from a connected device associated with an individual user, wherein the condition report corresponds directly to a current condition of the individual user, and wherein the power and data housing assembly comprises a voltage outlet and a data port, wherein the voltage outlet comprises at least one of a line voltage AC outlet and a low voltage DC outlet;

selecting, with the visual indicator system, a status in response to the received condition report, wherein the selected status is indicative of a current, ongoing activity of the individual user, as defined by the condition report; and indicating to other users, with the visual indicator system, a selected status of the individual user via a visual indicator by commanding the visual indicator to select a particular configuration based upon the selected status.

11. The method of claim 10, wherein the visual indicator is a light fixture, and wherein commanding a selection of a particular configuration comprises selecting one of a plurality of colors of light for the light fixture to output, wherein an intensity of the output light is variable, and wherein the output light comprises a variable flashing cycle rate.

12. The method of claim 10 further comprising indicating a selected status via an auditory indicator configured to output an audio output signal.

13. The method of claim 12, wherein the auditory indicator operates in parallel with the visual indicator.

14. The method of claim 10, wherein the selected status is indicative of one of: "busy," "available," and "away".

15. The method of claim 10, wherein the condition report is indicative of at least one of: "on a call," "text message received," "voicemail received," "email message received," "call received," "user busy," "do not disturb," and "user away".

16. The method of claim 10, wherein said wirelessly receiving the condition report from a connected device comprises receiving a condition report via one of a Bluetooth receiver, a near field communication (NFC) receiver, and a Wi-Fi receiver.

17. The method of claim 10, wherein the connected device comprises one of a portable computing device, a computer, and a cellphone.

18. A power and data housing assembly configured to support at least one electrical device, the power and data housing assembly comprising:

a voltage outlet comprising at least one of a line voltage AC outlet and a low voltage DC outlet;

a data port;

a housing body configured to retain and support an electrical device assembly;

wherein the electrical device assembly comprises:

a communications module configured to wirelessly receive a condition report from a wirelessly connected device associated with an individual user, wherein the condition report corresponds directly to a current condition of the individual user;

a processor configured to select a status in response to the condition report received by the communication module, wherein the selected status is indicative of a current, ongoing activity of the individual user, as defined by the condition report; and an indicator configured to indicate to other users a selected status of the individual user based upon at least one of a visual and auditory configuration of the indicator;

wherein the processor is further configured to select a particular configuration for the indicator, based upon the selected status.

19. The power and data housing assembly of claim 18, wherein the communications module is configured as one of a Bluetooth receiver, a near field communication (NFC) receiver, and a Wi-Fi receiver.

20. The power and data housing assembly of claim 18, wherein the connected device comprises one of a portable computing device, a computer, and a cellphone.

* * * * *